US011484073B1

(12) United States Patent
Sharma

(10) Patent No.: US 11,484,073 B1
(45) Date of Patent: Nov. 1, 2022

(54) NECKTIE SYSTEM AND METHOD OF USE

(71) Applicant: Dinesh Sharma, Markham (CA)

(72) Inventor: Dinesh Sharma, Markham (CA)

( * ) Notice: Subject to any disclaimer, the term of this patent is extended or adjusted under 35 U.S.C. 154(b) by 0 days.

(21) Appl. No.: 16/582,912

(22) Filed: Sep. 25, 2019

(51) Int. Cl.
*A41D 25/00* (2006.01)

(52) U.S. Cl.
CPC ..... *A41D 25/003* (2013.01)

(58) Field of Classification Search
CPC .... A41D 25/003; A41D 25/00; A41D 25/005; A41D 25/16; A41D 2200/10; Y10T 24/1924; A41F 1/004
USPC ..... 2/144, 145
See application file for complete search history.

(56) References Cited

U.S. PATENT DOCUMENTS 1,434,797 A * 11/1922 Shannon ..... A41D 25/003 2/145
1,751,963 A * 3/1930 Weinschreider ..... A41D 25/003 2/145
2,588,576 A * 3/1952 Roop ..... A41D 25/003 2/145
2,652,569 A * 9/1953 Confino ..... A41D 25/003 2/145
2,736,033 A * 2/1956 Brunetti et al. ..... A41D 25/003 2/145
2,746,055 A * 5/1956 Gleason ..... A41D 25/003 2/145
5,109,547 A * 5/1992 Abdallah ..... A41D 25/003 2/144
5,239,707 A * 8/1993 Pileggi ..... A41D 25/003 2/145
5,315,713 A * 5/1994 Pileggi ..... A41D 25/003 2/144
5,813,053 A * 9/1998 Pileggi ..... A41D 25/003 2/145
5,815,835 A * 10/1998 Craddock ..... A41D 27/08 2/144
8,056,147 B1 * 11/2011 Patel ..... A41D 25/003 2/145
D833,106 S * 11/2018 Kennedy, Jr. ..... D2/605
2006/0090241 A1 * 5/2006 Pitts ..... A41D 25/003 2/144
2008/0072362 A1 * 3/2008 Shearon ..... A41D 25/003 2/144
2017/0367419 A1 * 12/2017 Lewis ..... A41D 25/003
2018/0228232 A1 * 8/2018 Fisher ..... A41F 9/025
2020/0337397 A1 * 10/2020 Barnswell ..... A41D 25/003

FOREIGN PATENT DOCUMENTS

CA 2380600 A1 * 10/2003 ..... A41D 27/12
KR 20000056945 A * 9/2000 ..... A44B 1/24

* cited by examiner

*Primary Examiner* — F Griffin Hall
(74) *Attorney, Agent, or Firm* — Leavitt Eldredge Law Firm; Richard Eldredge

(57) ABSTRACT

A necktie system includes a necktie extending from a first end to a second end, the necktie to secure around a neck of a wearer; a first channel attached to a back surface of the necktie, the first channel having a body with button holes extending through a thickness of the first channel; and a gap created between the channel and the back surface of the necktie such that the second end of the necktie can be inserted through the first channel and be positioned between the first channel and the back surface; the button holes are configured to secure the necktie to a plurality of buttons on a wearer's shirt.

3 Claims, 4 Drawing Sheets

NECKTIE SYSTEM AND METHOD OF USE

BACKGROUND

1. Field of the Invention

The present invention relates generally to neckties, and more specifically, to a necktie system that includes one or more channels on a back surface of the necktie that are configured to engage with buttons on a shirt, thereby retaining the necktie against the shirt.

2. Description of Related Art

Neckties are well known in the art and are effective means to accessorize an outfit, particularly in a formal setting. For example, FIG. 1 depicts a conventional necktie 101 having an elongated tie 103 and a tail 105, wherein the necktie is configured to secure around a neck of the user via a portion 107 of the tie. During use, the user will secure and tie the necktie as desired, wherein the tie lies on a front of the wearer's shirt.

One of the problems commonly associated with necktie 101 is misalignment of the elongated tie 103 from the tail 105, as shown in FIG. 1. In addition, it is common for the necktie to become inconvenient by falling away from the wearer's shirt, thereby posing the risk of damage or soiling to the necktie.

Accordingly, although great strides have been made in the area of necktie systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
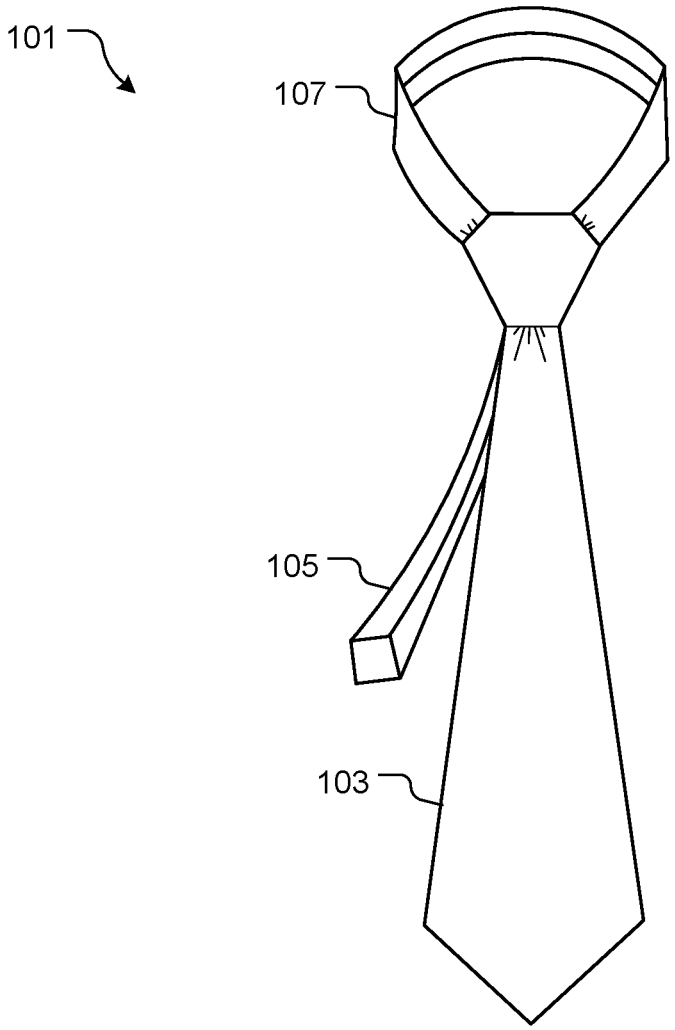
FIG. 1 (Prior Art)
FIG. 1 is a front view of a common necktie.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional neckties. Specifically, the present invention includes one or more channels secured to a back surface of the necktie and configured to receive the second end of the necktie and further attach to a plurality of buttons of the wearer's shirt, thereby keeping the necktie secured flat against the front of the shirt. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
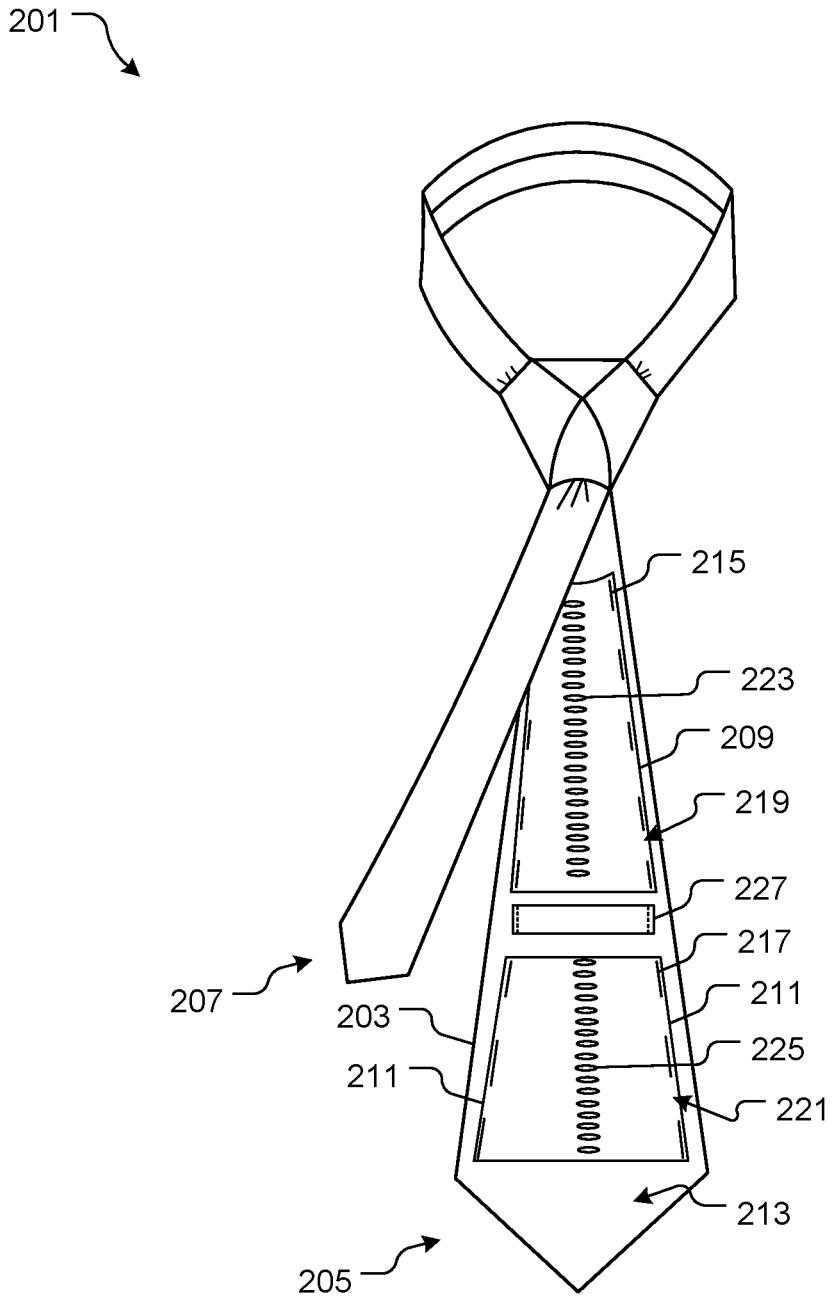
FIG. 2 is a back view of a necktie system in accordance with a preferred embodiment of the present application.
Figure 3:
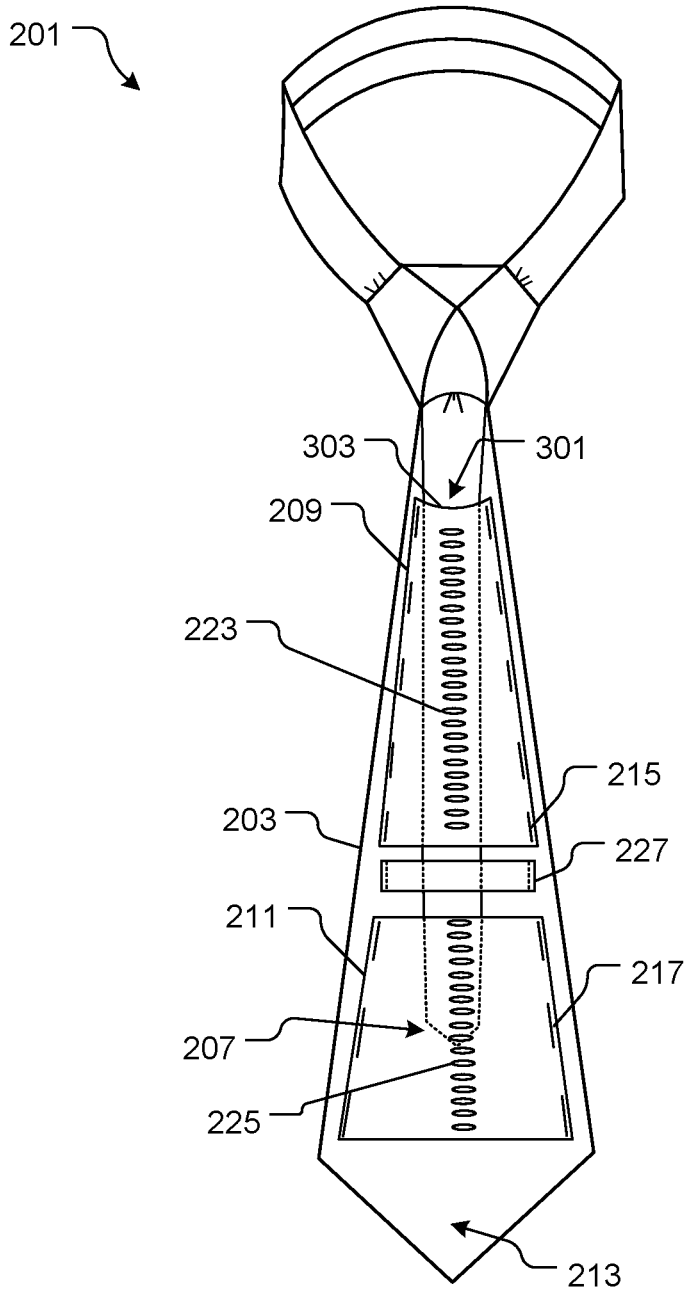
FIG. 3 is a back view of the system of FIG. 2 with the second end of the tie engaged with the first and second channels.

Referring now to the drawings wherein like reference characters identify corresponding or similar elements throughout the several views, FIGS. 2 and 3 depict back views of a necktie system 201 in accordance with a preferred embodiment of the present application. It will be appreciated that system 201 overcomes one or more of the above-listed problems commonly associated with conventional neckties.

In the contemplated embodiment, system 201 includes a necktie 203 that extends from a first end 205 to a second end 207. It should be appreciated that the material, pattern, and style of the necktie can vary as is known in the art. System 201 further includes a first channel 209 and a second channel 211, the first and second channels being secured to a back surface 213 of the tie. It should be appreciated that the channels can vary in length, and in some embodiments it is contemplated that there can be fewer or more channels. Further, it should be appreciated that the channel forms a gap between the back surface of the tie and the channel, thereby providing ease in securing the channel and tie to one or more buttons.

As shown, in the preferred embodiment, the channels are secured via stitching 215, 217, wherein the stitching includes spaces 219, 221, thereby allowing for flexibility in movement and preventing puckering of the necktie. It is contemplated however, that the channels could be secured via alternate means, such as adhesives or the like.

System 201 further includes a plurality of button holes 223, 225 that extend through the one or more channels, the plurality of button holes being configured to engage with and receive a plurality of buttons on the user's shirt, thereby securing the necktie to the shirt. As shown, it is contemplated that many button holes can be included, thereby allowing for flexibility in the style of shirt being used with the necktie.

System 201 can further include one or more slots 227 as desired to further aid in securing the second end 207 of the tie within the channels and to the back surface 213 of the tie.

It should be appreciated that one of the unique features believed characteristic of the present application is the inclusion of the one or more channels with button holes, thereby allowing for the system to engage easily with one or more buttons on the front of a shirt.

As best shown in FIG. 3, the second end 207 of the tie can be tucked through a gap 301 created between the channels and the back surface 213 of the tie, thereby positioning the second end between the channels and the back surface. As further shown, in some embodiments, the top end of the first channel can include a curved edge 303 for ease of the tucking of the second end of the tie through the channels.

Figure 4:
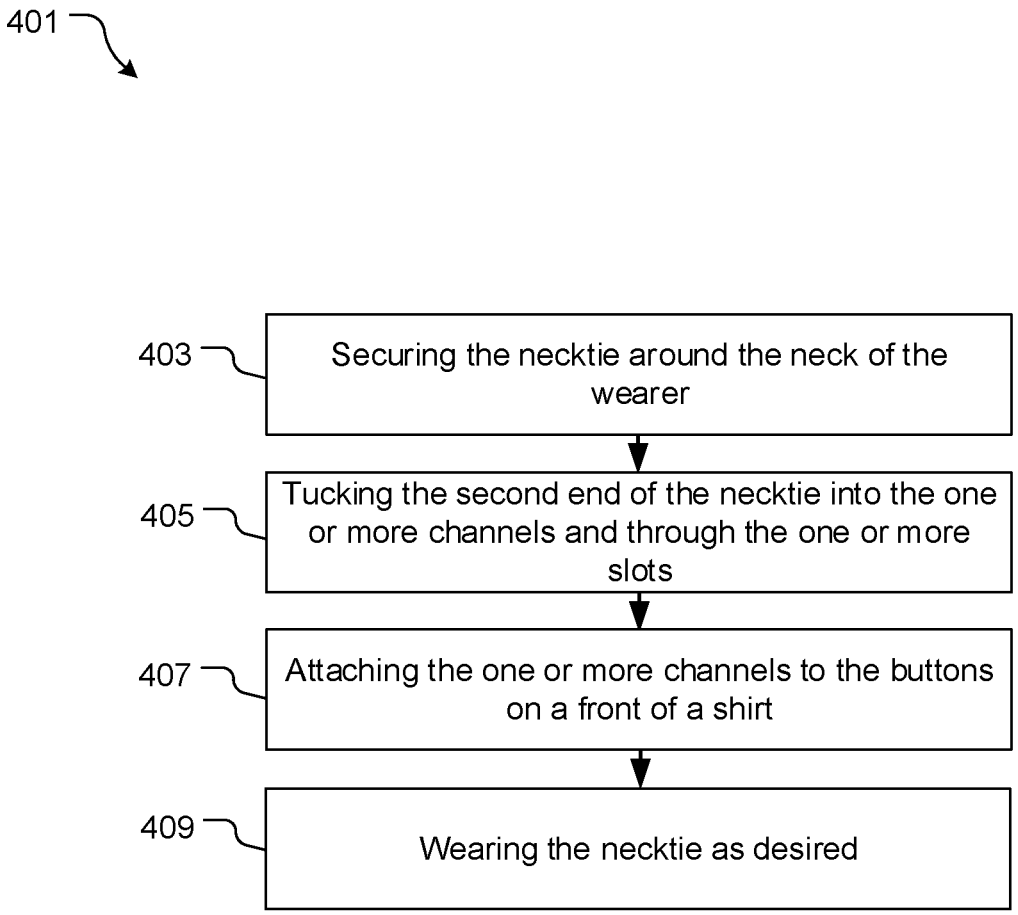
FIG. 4 is a flowchart of a method of use of the system of FIG. 2.

In FIG. 4, a flowchart 401 depicts the method of use of system 201. During use, the user will secure and knot the tie around their neck as desired, as shown with box 403. The user can then tuck the second end of the tie through the one or more channels, as shown with box 405. The channels can then be used to secure to the one or more buttons of the shirt so that the necktie can be worn flat against the user's chest, as shown with boxes 407, 409.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A necktie system, comprising:

a necktie extending from a first end to a second end, the necktie configured to secure around a neck of a wearer and releasably engage with a shirt;

a first channel extending along a back surface of the necktie, the first channel positioned between a first fabric body with a first plurality of button holes extending through a thickness of the first fabric body, and the back surface of the necktie;

a plurality of stitched sections, the plurality of stitched sections consisting of a first plurality of stitched sections extending along a right side length of the first channel, a second plurality of stitched sections extending along a left side length of the first channel, a third plurality of stitched sections extending along a right side length of a second channel, and a fourth plurality of stitched sections extending along a left side length of the second channel;

a plurality of spaces, with a respective space of the plurality of spaces created between each stitched section of the plurality of stitched sections such that no attachment between the first channel and the necktie is present within the plurality of spaces;

the first channel accessible via an opening at a top edge of the first channel and such that the second end of the necktie can be inserted through the first channel and be positioned between the first fabric body and the back surface;

the second channel extending along the back surface of the necktie at a position below the first channel, the second channel having second fabric body with a second plurality of button holes, the second channel being spaced apart from the first channel; and a slot attached to the back surface of the necktie, the slot engaging with the second end of the necktie and positioned between the first channel and the second channel;

wherein the first plurality of button holes and the second plurality of button holes provide a means to secure the necktie to a plurality of buttons on the shirt;

wherein the first plurality of button holes and the second plurality of button holes are configured to releasably engage with one or more buttons of the shirt.

2. The system of claim 1, wherein the top edge of the first fabric body has a curved edge.

3. A method of wearing a necktie, the method comprising:

providing the system of claim 1;

positioning the necktie around the wearer's neck and tying the necktie as desired;

tucking the second end of the necktie through the first channel; and attaching the first body of the first channel to a front of the wearer's shirt via the first plurality of button holes and plurality of buttons.

* * * * *